US009352564B2

(12) United States Patent
Van Brocklin et al.

(10) Patent No.: US 9,352,564 B2
(45) Date of Patent: May 31, 2016

(54) DETERMINING AN ISSUE IN AN INKJET NOZZLE WITH IMPEDANCE MEASUREMENTS

(75) Inventors: Andrew L. Van Brocklin, Corvallis, OR (US); Eric T. Martin, Corvallis, OR (US); Alexander Govyadinov, Corvallis, OR (US); David Maxfield, Philomath, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/372,715

(22) PCT Filed: Apr. 19, 2012

(86) PCT No.: PCT/US2012/034182

§ 371 (c)(1),
(2), (4) Date: Jul. 16, 2014

(87) PCT Pub. No.: WO2013/158099

PCT Pub. Date: Oct. 24, 2013

(65) Prior Publication Data

US 2015/0029252 A1 Jan. 29, 2015

(51) Int. Cl.

| | |
|---|---|
| ***B41J 2/045*** | (2006.01) |
| ***B41J 2/14*** | (2006.01) |
| ***B41J 29/393*** | (2006.01) |

(52) U.S. Cl.

CPC ..... *B41J 2/14153* (2013.01); *B41J 2/0451* (2013.01); *B41J 2/0458* (2013.01); *B41J 29/393* (2013.01); *B41J 2002/14354* (2013.01)

(58) Field of Classification Search

CPC .. B41J 2/04541; B41J 2/04563; B41J 2/0458; B41J 2/04596; B41J 2/0451; B41J 2/14153; B41J 29/393; B41J 2002/14354

USPC ..... 347/14, 17, 19, 40, 44, 57, 58, 61, 81

See application file for complete search history.

(56) References Cited

U.S. PATENT DOCUMENTS

| | | | | |
|---|---|---|---|---|
| 4,241,357 | A | 12/1980 | Anestos | |
| 6,257,694 | B1 * | 7/2001 | Tokumaru | B41J 2/19 347/19 |
| 7,387,374 | B2 * | 6/2008 | Kawamura | 347/72 |
| 8,336,981 | B2 * | 12/2012 | Chen et al. | 347/14 |
| 2011/0084997 | A1 | 4/2011 | Chen et al. | |

FOREIGN PATENT DOCUMENTS

| | | |
|---|---|---|
| CN | 101092075 | 12/2007 |
| CN | 101219600 | 7/2008 |
| JP | S-63141750 | 6/1988 |
| JP | 2005-041212 A | 2/2005 |

* cited by examiner

*Primary Examiner* — Thinh Nguyen

(74) *Attorney, Agent, or Firm* — Van Cott, Bagley, Cornwall & McCarthy

(57) ABSTRACT

A method for determining an issue in an inkjet nozzle with impedance measurements, includes taking a first impedance measurement to detect a drive bubble with an impedance sensor; and taking a second impedance measurement to detect said drive bubble with said impedance sensor after said first impedance measurement.

20 Claims, 7 Drawing Sheets

1200

| 1201 Time 1 (Bubble Expected) | 1202 Time 2 (Ink Expected) | 1203 Print Data (NOT Firing) | 1204 Print Data (Firing) |
|---|---|---|---|
| High Impedance (Bubble) | High Impedance (Bubble) | Deprime | Blockage or Deprime |
| High Impedance (Bubble) | Low Impedance (Ink) | Unexpected | Normal |
| Low Impedance (Ink) | High Impedance (Bubble) | Unexpected | Unexpected |
| Low Impedance (Ink) | Low Impedance (Ink) | Normal | Weak or No Fire |

1205 1206

DETERMINING AN ISSUE IN AN INKJET NOZZLE WITH IMPEDANCE MEASUREMENTS

BACKGROUND

In inkjet printing, ink droplets are released from an array of nozzles in a print head onto a printing medium, such as paper. The ink bonds to a surface of the printing medium and forms graphics, text, or other images. The ink droplets are released with precision to ensure that the image is accurately formed. Generally, the medium is conveyed under the print head while the droplets are selectively released. The medium's conveyance speed is factored into the droplet release timing.

Some inkjet printers include print heads that slide laterally across a swath, or width, of the printing medium during a print job. In such printers, the medium's conveyance is halted momentarily as the print head travels and releases the predetermined droplets along the swath of the medium. Other inkjet printers include print heads that remain stationary throughout a printing job. In these printers, an array of nozzles generally spans the entire swath of the printing medium.

Print heads typically include a number of ink chambers, also known as firing chambers. Each ink chamber is in fluid communication with one of the nozzles in the array and provides the ink to be deposited by that respective print head nozzle. Prior to a droplet release, the ink in the ink chamber is restrained from exiting the nozzle due to capillary forces and/or back-pressure acting on the ink within the nozzle passage. The meniscus, which is a surface of the ink that separates the liquid ink in the chamber from the atmosphere located below the nozzle, is held in place due to a balance of the internal pressure of the chamber, gravity, and the capillary force. The size of the nozzle passage is a contributing factor to the strength of the capillary forces. The internal pressure within the ink chamber is generally insufficient to exceed the strength of the capillary force, and thus, the ink is prevented from exiting the ink chamber through the nozzle passage without actively increasing the pressure within the chamber.

During a droplet release, ink within the ink chamber is forced out of the nozzle by actively increasing the pressure within the chamber. Some print heads use a resistive heater positioned within the chamber to evaporate a small amount of at least one component of the liquid ink. In many cases, a major component of the liquid ink is water, and the resistive heater evaporates the water. The evaporated ink component or components expand to form a gaseous drive bubble within the ink chamber. This expansion exceeds the capillary force enough to expel a single droplet out of the nozzle. Generally, after the release of single droplet, the pressure in the ink chamber drops below the strength of the capillary force and the remainder of the ink is retained within the chamber. Meanwhile, the drive bubble collapses and ink from a reservoir flows into the ink chamber replenishing the lost ink volume from the droplet release. This process is repeated each time the print head is instructed to fire.

BRIEF DESCRIPTION OF THE DRAWINGS

The accompanying drawings illustrate various examples of the principles described herein and are a part of the specification. The illustrated examples are merely examples and do not limit the scope of the claims.

DETAILED DESCRIPTION

As used herein, a drive bubble is a bubble formed from within an ink chamber to dispense a droplet of ink as part of a printing job or a servicing event. The drive bubble may be made of a vaporized ink separated from liquid ink by a bubble wall. The timing of the drive bubble formation may be dependent on the image to be formed on the printing medium.

The present specification describes principles including, for example, a method for determining an issue in an inkjet nozzle with multiple measurements of the ink chamber. The issue may include a blockage of the nozzle, the presence of a stray bubble in the ink chamber, a blockage of an inlet into the ink chamber, a weak drive bubble formation, other issues, or combinations thereof. Examples of such a method include taking a first impedance measurement of an ink chamber with an impedance sensor and taking a second impedance measurement of the ink chamber with the impedance sensor after the first impedance measurement. The measurements may be used to determine whether an issue exists and also determine the type of issue.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described is included in at least that one example, but not necessarily in other examples.

Figure 1:
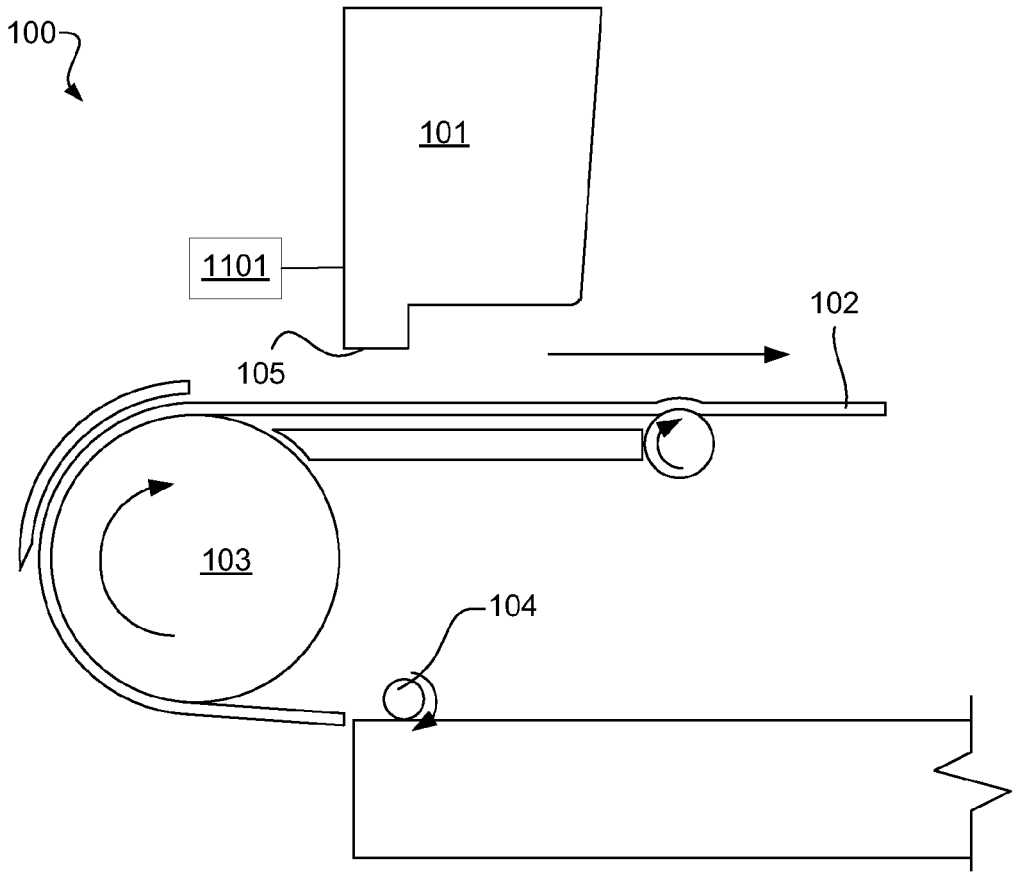
FIG. 1 is a diagram of illustrative components of a printer, according to principles described herein.

FIG. 1 is a diagram of illustrative components of a printer (100), according to principles described herein. In this example, the printer (100) includes a print head (101) positioned over a printing medium (102) traveling through the printer (100). The printer (100) further comprises a processor (1101) that is in communication with the print head (101) determines what issues the print head (101) is experiencing based, for example, on impedance measurements from the nozzles of the print head (101), as will be described in further detail below.

The printing medium (102) is pulled from a stack of media individually through the use of rollers (103, 104). In other examples, the printing medium is a continuous sheet or web. The printing medium may be, but is not limited to, paper, cardstock, poster board, vinyl, translucent graphics medium, other printing media, or combinations thereof.

The print head (101) may have a number of nozzles formed in its underside (105). Each nozzle may be in electrical communication with a processor that instructs the nozzles to fire at specific times by activating a heater within the ink chambers associated with each nozzle. The heater may be a heating element, resistive heater, a thin-film resistor, or other mechanism that may create a bubble within the ink chamber. In other examples, a piezo-electric element may create pressure in the ink chamber to file a desired nozzle.

Figure 2:
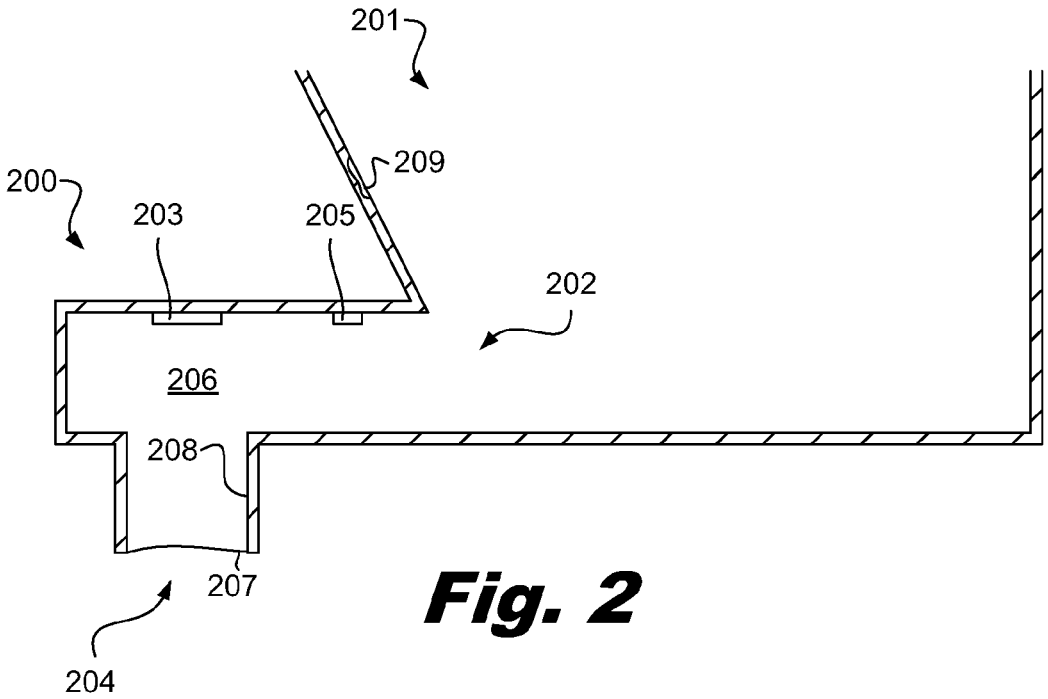
FIG. 2 is a cross sectional diagram of an illustrative ink chamber, according to principles described herein.

FIG. 2 is a cross sectional diagram of an illustrative ink chamber (200), according to principles described herein. In this example, the ink chamber (200) is connected to an ink reservoir (201) through an inlet (202). A heater (203) is positioned over the nozzle (204). An impedance sensor (205) is positioned near the heater (203). Capillary forces cause the ink to form a meniscus (207) within a passage (208) of the nozzle (204). The meniscus is a barrier between the liquid ink (206) in the chamber (200) and the atmosphere located below the nozzle (204). The internal pressure within the ink chamber (200) does not exceed the capillary forces unless the chamber's internal pressure is actively increased.

The impedance sensor (205) may have a plate made of a material of a predetermined resistance, such as a metal. In some examples, the metal plate is made of tantalum, copper, nickel, titanium, or combinations thereof. In some examples, the metal is capable withstanding corrosion due to the metal's contact with the liquid ink (206). A ground element (209) may also be located anywhere within the ink chamber (200) or ink reservoir (201). In the example of FIG. 2, the ground element (209) is depicted in the ink reservoir (201). In some examples, the ground element is an etched portion of a wall with a grounded, electrically conductive material exposed. In other examples, the ground element (209) may be a grounded electrical pad. When, in the presence of liquid ink (206), a voltage is applied to the impedance sensor (205), an electrical current may pass from the impedance sensor (205) to the ground element (209).

The liquid ink (206) may be more conductive than the air or other gasses in the drive bubble. In examples where the liquid ink contains some partly aqueous vehicle mobile ions, and a portion of the sensor's surface area is in contact with the liquid ink (206) when a current pulse or voltage pulse is applied to the sensor (205), the sensor's impedance is lower than it would otherwise be without the ink's contact. On the other hand, when an increasingly larger amount of the sensor's surface area is in contact with the gasses of a drive bubble and a voltage or current of the same strength is applied to the sensor (205), the sensor's impedance increases. The sensor (205) may be used to make a measurement of some component of impedance, such as the resistive (real) components at a frequency range determined by the type of voltage source supplying the voltage or current to the sensor. In some examples, a cross sectional geometry of the drive bubble or stray bubbles along the electrical path between the impedance sensor (205) and the ground element (209) may also affect the impedance value.

FIGS. 3-6 depict an illustrative inkjet nozzle with a healthy condition during an ink droplet release. A healthy inkjet nozzle is a nozzle that is associated with an ink chamber, heater, and other components that are free of issues that would cause the nozzle to fire improperly. An improperly firing nozzle includes a nozzle that fails to fire at all, fires early, fires late, releases too much ink, releases too little ink, or combinations thereof.

FIGS. 3-6 depict the stages of the drive bubble from its formation to its collapse. These depictions are merely illustrative. Bubble size and geometry are determined by the factors such as an amount of heat generated by the heater, the internal pressure of the ink chamber, the amount of ink in the ink reservoir, the viscosity of the liquid ink, the ion concentration of the ink, the geometry of the ink chamber, volume of the ink chamber, the diameter size of the nozzle passage, the position of the heater, other factors, or combinations thereof.

Figure 3:
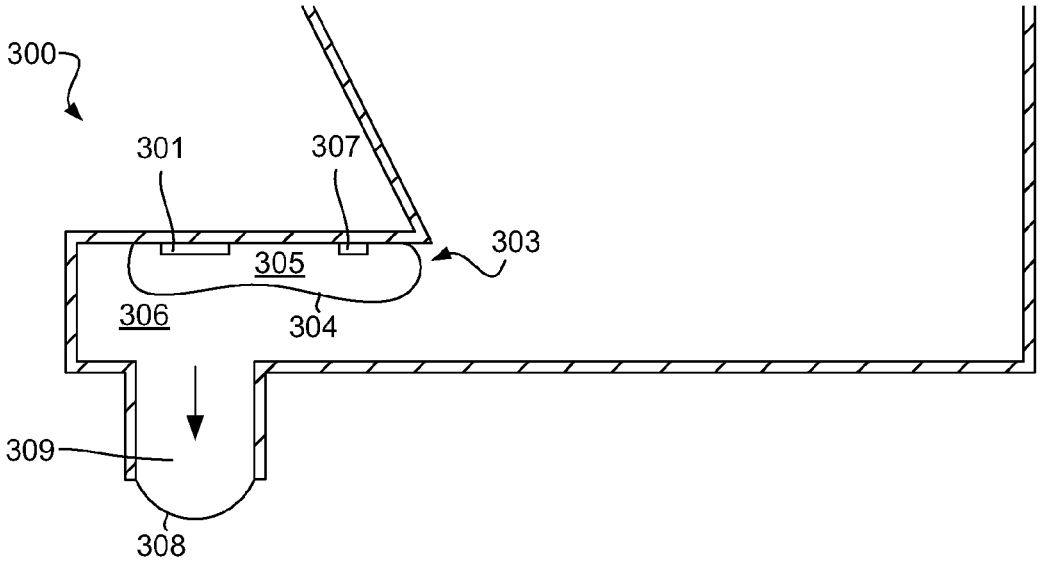
FIG. 3 is a cross sectional diagram of an illustrative ink chamber, according to principles described herein.

FIG. 3 is a cross sectional diagram of an illustrative ink chamber (300), according to principles described herein. In FIG. 3, a heater (301) in the ink chamber (300) is initiating drive bubble formation. A voltage is applied to the heater (301), and the heater's material resists the associated current flow driven by the voltage resulting in Joule heating. This heats the heater's material to a temperature sufficient to evaporate liquid ink in contact with the heater (301). As the ink evaporates, the ink in gaseous form expands forming a drive bubble (303). A bubble wall (304) separates the bubble's gas (305) from the liquid ink (306). In FIG. 3, the drive bubble (303) has expanded to such a volume that the heater (301) and the sensor (307) make physical contact just with the bubble's gas (305). Since the sensor is in contact with the bubble's gas (305), the sensor (307) measures an impedance value that indicates the drive bubble (303) is in contact with the sensor (307).

The expansion of the drive bubble (303) increases the internal pressure of the ink chamber (300). During the stage depicted in FIG. 3, the chamber's internal pressure displaces enough ink to force the meniscus (308) within the nozzle's passage (309) to bow outward. However, at this stage, the capillary forces continue to keep all of the liquid ink (306) together.

Figure 4:
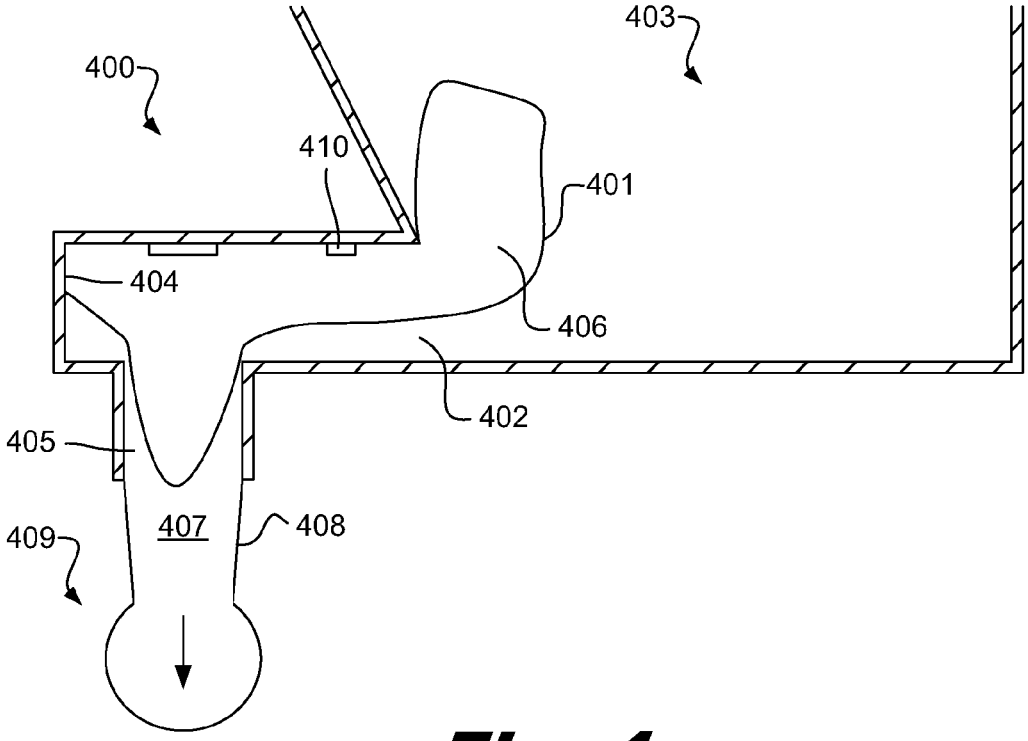
FIG. 4 is a cross sectional diagram of an illustrative ink chamber, according to principles described herein.

FIG. 4 is a cross sectional diagram of an illustrative ink chamber (400), according to principles described herein. In this figure, more time has passed from the initiation of the drive bubble, and the drive bubble's volume has continued to increase. At this stage, the drive bubble wall (401) extends through a chamber inlet (402) into an ink reservoir (403). On the other side of the chamber, the bubble wall (401) makes contact with the chamber's far wall (404). Another portion of the bubble wall (401) enters into the nozzle passage (405).

The drive bubble (406) may substantially isolate the liquid ink (407) in the chamber passage (405) from the rest of the ink chamber (400). As the drive bubble (406) continues to expand into the nozzle passage (405), the pressure in the nozzle passage (405) increases to such a degree that the liquid ink (407) in the passage (405) pushes the meniscus (408) out of the nozzle passage (405) increasing the meniscus's surface area. As the meniscus (408) increases in size, a droplet (409) forms that pulls away from the passage (405).

At this stage, the drive bubble (406) continues to cover the entire surface area of the sensor (410). Thus, the sensor (410) may measure the drive bubble's presence by measuring a higher resistance or impedance that the sensor (410) would otherwise measure if the sensor (410) were in contact with liquid ink (407).

Figure 5:
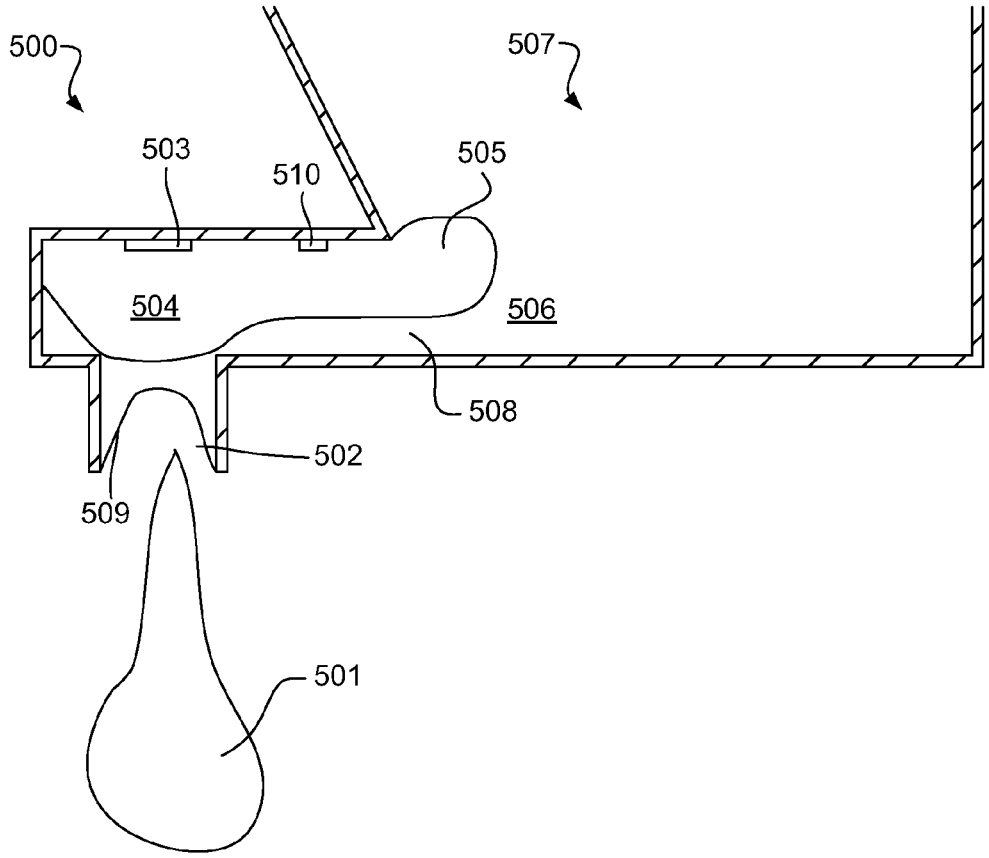
FIG. 5 is a cross sectional diagram of an illustrative ink chamber, according to principles described herein.

FIG. 5 is a cross sectional diagram of an illustrative ink chamber (500), according to principles described herein. In this example, the ink droplet (501) is breaking free from the nozzle passage (502).

At this stage, the gas (504) of the drive bubble (505) cools in the absence of the heat from the heater (503). As the gas (504) cools, the drive bubble (505) shrinks, which depressurizes the ink chamber (500). The depressurization pulls liquid ink (506) from the ink reservoir (507) into chamber (500) through the chamber inlet (508) to replenish the ink volume lost to the droplet release. Also, the meniscus (509) is pulled back into nozzle passage (502) due to the depressurization. The sensor (510) continues to measure a comparatively high impedance value because the drive bubble (505) continues to isolate the sensor (510) from the liquid ink (506).

Figure 6:
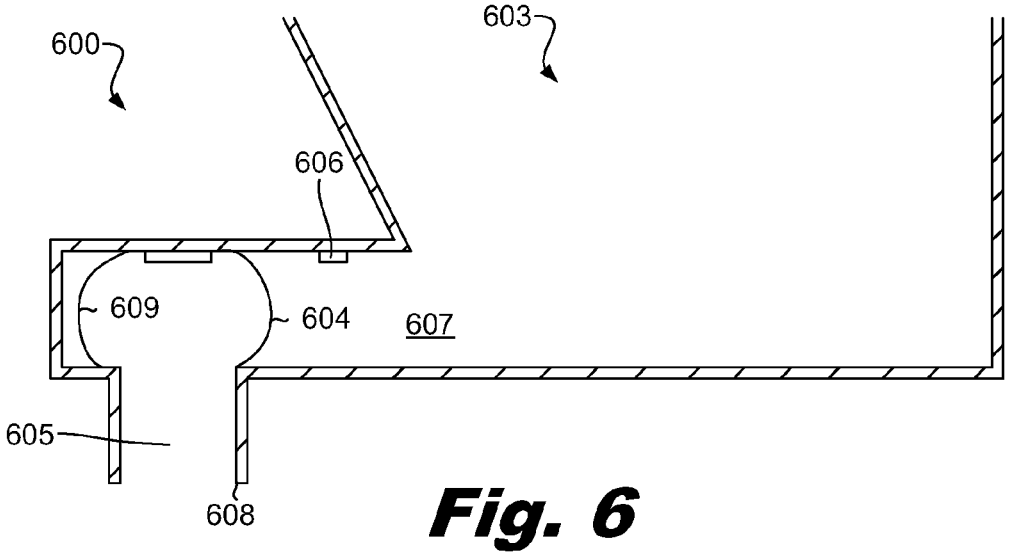
FIG. 6 is a cross sectional diagram of an illustrative ink chamber, according to principles described herein.

FIG. 6 is a cross sectional diagram of an illustrative ink chamber (600), according to principles described herein. In this figure, the drive bubble merges with the meniscus. As the internal pressure of the ink chamber (600) increases due to the ink flow from the reservoir (603), the bubble wall (604) is forced back towards the nozzle passage (605). During this bubble wall retraction, the reservoir side bubble wall (604) pulls away from the sensor (606). As the sensor (606) reestablishes contact with the liquid ink (607), the sensor measures a lower impedance value due to the higher electrical conductivity of the liquid ink (607).

At this stage under healthy operating conditions, the reservoir side bubble wall (604) resists a greater amount of pressure than the far bubble wall (609) due to the ink flow from the ink reservoir (603) reestablishing a pressure equilibrium in the ink chamber (600). The ink flow replenishes the lost ink volume, and the meniscus moves to the end (608) of the nozzle passage (605).

Again, FIGS. 3-6 depict an example of an illustrative inkjet nozzle with a healthy condition during an ink droplet release. However, many conditions may adversely affect the droplet release. For example, a blockage of the nozzle passage may prevent the formation of an ink droplet. The measurement results when a nozzle is blocked in this way may show that the drive bubble forms normally, but that the drive bubble collapses more slowly than expected.

In other examples, a blockage of the ink chamber inlet may prevent ink from flowing from the ink reservoir to reestablish a pressure equilibrium within the ink chamber. In such a situation, the liquid ink may fail to come back into contact with the sensor. In other cases, the ink never enters the chamber during the priming process.

Blockages in either the inlet or nozzle passage may occur due to particles in the ink or solidified portions of the ink. The ink may solidify from exposure to air in the nozzle passage or from heating from the heater. Generally, ink chambers have a volume in the picoliter scale, thus, very small particles may partially or completely form blockages within the ink chamber.

In some cases, liquid ink may dry and solidify on the heater and become a thermal barrier that inhibits the heater's ability to vaporize the liquid ink. The thermal barrier may completely hinder the heater's ability to form a drive bubble or limit the heater to forming a smaller, weaker drive bubble than desired.

Also, the presence of a stray bubble may affect the ink droplet release. Since droplet release timing effects the accuracy of the image formed on the printing medium, the latency from initiating the drive bubble formation to the actual droplet release needs to be predictable. Sometimes air bubbles form in either the body of the ink in the ink reservoir or in the chamber itself due to air or other gasses out-gassing from the ink. In some cases, this causes a semi-permanent stray bubble of gas to be created in or migrate towards the inkjet chamber. Such a stray bubble may reside in the ink chamber. The presence of these stray bubbles within the ink chamber may affect the overall compressive condition of the ink. For example, the mechanical compliance of a stray bubble may absorb some of the internal pressure intended to displace ink out of the nozzle passage and delay the droplet release. Further, a stray bubble's wall may deflect the drive bubble away from the nozzle passage in such a manner that the droplet fails to form or forms more slowly.

In some examples, the ink flow from the reservoir may fail to establish a pressure equilibrium near the chamber's far wall and allow a residual portion of a drive bubble to remain in the ink chamber after the drive bubble would have otherwise collapsed. In other examples, the ink may become frothy resulting in the formation of a plurality of miniature air bubbles in the liquid ink. The froth may be formed due to an air leak into the chamber, a contaminant in the ink, an unintended mechanical agitation that mixes air from the nozzle passageway with the ink in the chamber, another mechanism, or combinations thereof. The froth may also be formed from a hurtful prime, which is a failed priming process that allows air to leak into the chamber as bubbles.

Due to the variety of effects that stray bubbles may have on a nozzle's health, the sensor may make inconsistent measurements. For example, frothy ink may measure as having a higher impedance value while in contact with the liquid ink due to some contact with the small air bubbles. In situations where a larger stray bubble is present, the liquid ink may fail to rewet the sensor's plate.

As will be explained in more detail below, these various issues will have differentiating characteristics as measured by the sensor (e.g. 205 in FIG. 2) in the ink chamber. For example, the life span of a drive bubble as measured by the sensor can indicate which, if any, of these various issues is occurring. Consequently, the output from that sensor can be used to determine which of the various issues described is occurring in a particular nozzle of the print head.

Figure 7:
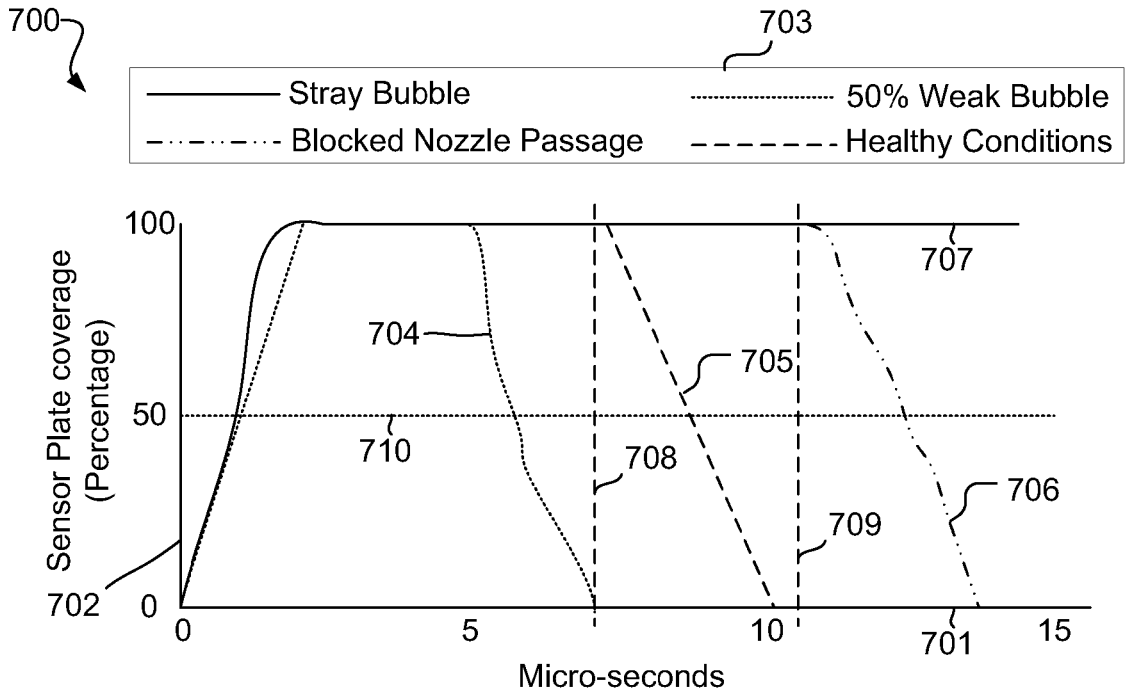
FIG. 7 is a diagram of an illustrative chart showing drive bubble life spans, according to principles described herein.

FIG. 7 is an illustrative chart (700) showing typical drive bubble life spans per type of nozzle health issue, according to principles described herein. In this example, the x-axis (701) schematically represents time in microseconds. Zero microseconds may correspond to the initiation of the drive bubble formation. The y-axis (702) may schematically represent the drive bubble's coverage of the sensor plate's surface area, which corresponds to the real portion of the impedance measurement.

The drive bubble's coverage depicted on the y-axis (702) may correspond to the impedance measurement taken by the sensor in the ink chamber over time. For example, a minimum impedance measurement may indicate that the entire surface area of the sensor is in contact with the ink and may correspond to zero percent surface area coverage on the y-axis (702). On the other hand, a maximum impedance measurement may indicate that the entire surface area of the sensor is in contact with the drive bubble and may correspond to a hundred percent surface area coverage on the y-axis (702). Impedance measurements between the minimum and maximum may indicate that a portion of the sensor's surface area is covered with liquid ink and another portion is covered by the drive bubble. In some examples, a higher impedance measurement indicates that a greater portion of the surface area is covered by the drive bubble. On the other hand, a lower impedance measurement may indicate that a majority of the surface area is a covered by liquid ink.

A legend (703) indicates which lines (704, 705, 706, 707) are associated with specific nozzle conditions, such as a healthy condition, a weak bubble, a blocked nozzle passage, and the presence of a stray bubble. The values of the chart (700) in the example of FIG. 7 may be experimentally determined prior to a print job and may be specific to ink chambers of like geometry, size, etc.

In some examples, the sensor takes a first measurement and a second measurement during a print job to determine whether the sensor is in contact with liquid ink or the drive bubble. In such an example, multiple measurements may be taken per firing to determine the health condition of a nozzle. For example, if the sensor is instructed to take a first measurement at seven microseconds (708) and the sensor measures the minimum impedance value, this may indicate that the nozzle failed to form a drive bubble or formed a weak bubble at about fifty percent strength or less. On the other hand, if the first measurement recorded the maximum impedance value, the processor may be unable to determine with certainty that the nozzle has a healthy condition or not because the drive bubble life span for a healthy drive bubble, a blocked nozzle drive bubble, and a stray bubble would all measure at the maximum value at seven microseconds.

If it is determined that there was either no drive bubble formed or that just a weak drive bubbled was formed from the first measurement, then just the first measurement may be taken.

However, if the first measurement was inconclusive because the impedance value was recorded at a maximum value, the processor may instruct a second measurement to be taken. In some examples, the processor instructs that the second measurement (709) is taken at eleven microseconds since activating the drive bubble formation mechanism. If the second measurement records the minimum impedance value, which indicates that the sensor is not in contact with the drive bubble, this may indicate that the nozzle has a healthy condition. Determining that the inkjet nozzle is healthy may be based off of a combination of the first impedance measurement reading that the sensor was in contact with a drive bubble at seven seconds and that second drive bubble was not in contact with the drive bubble at eleven seconds.

If the second measurement recorded the maximum impedance value, then this may indicate that the nozzle has an unhealthy condition because under healthy operating conditions the drive bubble would have already collapsed. However, the processor may be unable to determine the type of issue with certainty because both a stray bubble and a blocked nozzle bore may record the maximum impedance value.

To distinguish between the stray bubble and a blocked nozzle, the processor may instruct that a third measurement be taken after a drive bubble formed with a blocked nozzle would have been formed. In FIG. 7, if such a measurement yields the minimum impedance value, it indicates that the issue is a blocked bore. Otherwise, the issue is would be a stray bubble.

By taking multiple measurements after activating a drive bubble formation mechanism, the types of nozzle health conditions may be distinguished from each other with greater accuracy.

In some examples, the geometry of the ink chamber, placement of the sensor or heater, or other ink chamber parameters may yield different, but predictable results for healthy drive bubbles, blocked bore drive bubbles, stray bubbles, or drive bubbles at fifty percent strength other than what is shown in the example of FIG. 7. In such examples, the timing of the first and second measurement may be different than the timing in the example of FIG. 7.

Upon indication that there is an unhealthy nozzle condition, a processor may determine to make a remedial action. For example, the processor may determine to increase the energy applied to the heater to compensate for a weak bubble formation. Also, the processor may determine to inactivate the nozzle, send an issue notification, compensate for the nozzle's condition by instructing another nozzle to perform the unhealthy nozzle's job, initiate other remedial actions, or combinations thereof.

In some examples, circuitry converts the measurements into binary data. For example, a "1" may represent a high impedance measurement that is above a predetermined threshold value schematically represented in FIG. 7 as line (710). On the other hand, a "0" may represent a low impedance measurement, which may be lower than the predetermined threshold value. In this manner, the measurements may be simplified for use with logic and simplify processing circuitry.

An impedance sensor in accordance with the principles described herein may take measurements within a two microsecond margin of error or less. Thus, the measurements taken are accurate enough to measure impedance values within the narrow time frame needed to distinguish between healthy and unhealthy nozzle conditions.

Figure 8:
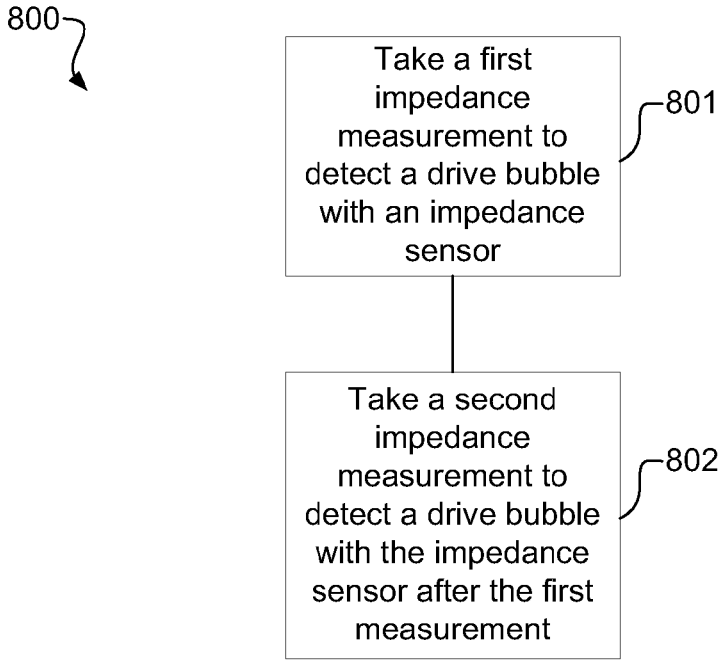
FIG. 8 is a diagram of an illustrative method for determining an issue in an inkjet nozzle, according to principles described herein.

FIG. 8 is a diagram of an illustrative method (800) for determining an issue in an inkjet nozzle, according to principles described herein. In this example, the method (800) includes taking (801) a first impedance measurement of an ink chamber with an impedance sensor, and taking (802) a second measurement of the ink chamber with the impedance sensor after the first impedance measurement is taken.

In some examples, the combination of the first and second measurements is used to determine whether an issue exists. In some examples, first measurement, the second measurement, or combinations thereof may be used to determine the type of issue as well.

In some examples, the processor automatically takes a second measurement if a first measurement is taken. However, in alternative examples, a processor evaluates the first measurements before instructing that a second measurement be taken. In such an example, the processor may discontinue taking measurements when the processor has confidence that it has accurately distinguished the correct issue from the other possibilities. In some examples, the second impedance measurement may be taken two to seven microseconds after the first impedance measurement.

The method may be employed on an actual printing job. In this manner, issues may be detected in real time and avoid wasting time and resources if an issue develops during a printing job. Also, the method may take just a few microseconds to perform and may be repeated often without interfering with the printing process. Further, multiple nozzle may be diagnosed during the print job. Additionally, the method may seem transparent to the user.

Further, the method may be employed during a servicing event as well. A servicing event may take place during, before, or after a printing job. To prevent liquid ink from drying in and around the nozzle passage, the nozzle may be fired into a service station. In examples where the print head scans across the printing medium's swath, the service station may be located to the side of the swath. The print head may dock at the printing station during a printing job as needed and/or the print head may dock at the service station when the print head is not in use. While docked, the print head may fire a single nozzle at a time to determine a health issue with that nozzle. By firing a single nozzle at a time, misreads from other nozzles being evaluated at the same time may be reduced. In some examples, some or all of the nozzles may be fired in a particular sequence to control the spacing and reduce interference with the diagnosis of other nozzles. In examples, where the print head remains stationary with respect to the swath of the printing medium, a service station may move to the print head for servicing as needed.

The method may be performed with stationary nozzles arrays or with print heads that traverse the printing medium's width during a print job.

The drive bubble formation mechanism may be a heater or other mechanism capable of creating a drive bubble within the ink chamber. The measurement may be taken with an impedance sensor that is capable of measuring resistance, impedance, or combinations thereof. The measurements may be taken within five to thirty five microseconds after activating the drive bubble formation mechanism. Also, the sensor may be placed within a region of the ink chamber where the ink bubble is expected to exist.

The method may further include determining whether an issue exists based on the measurement. The issue that the method may determine may be a blockage of the nozzle, a formation of a weak bubble, a presence of a stray bubble, a blockage of a chamber inlet, or combinations thereof.

The method may also include initiating a remedial action with a processor in response to an issue. The remedial response may include using a second inkjet nozzle to compensate for the issue. In some examples, more than one additional nozzle may be used to compensate for the issue. In examples where the print head slides across the swath of the printing medium, the compensating nozzle or nozzles may be located on any portion of the print head. In examples where an array of nozzles is stationary with respect to the swath of the printing medium, the compensating nozzles may be located before or after the nozzle along a pathway traveled by the printing medium. In some examples, the compensating nozzle is a back-up nozzle intended for use when a nozzle has an issue. In alternative examples, the compensating nozzle is already operating and picks up additional tasks for the unhealthy nozzle in addition to the tasks already assigned to the compensating nozzle.

Another remedial action may include sending a notification about the issue. The notification may be sent to a printer operator, a maintenance service provider, a data base, a remote location, or combinations thereof. The nozzle may be disabled until the nozzle receives the needed attention. In some examples, the processor determines if the nozzle may still function for a time despite having an issue. The processor may determine to take no action or wait to make a remedial action.

In some examples, the printer already has built-in mechanisms and/or procedures to deal with blocked nozzles, stray bubbles, weak bubble formations, blocked inlets, other issues, or combinations thereof. These built-in mechanisms may be performed automatically by the printer or print head without the assistance of a printer user or repair person.

Figure 9:
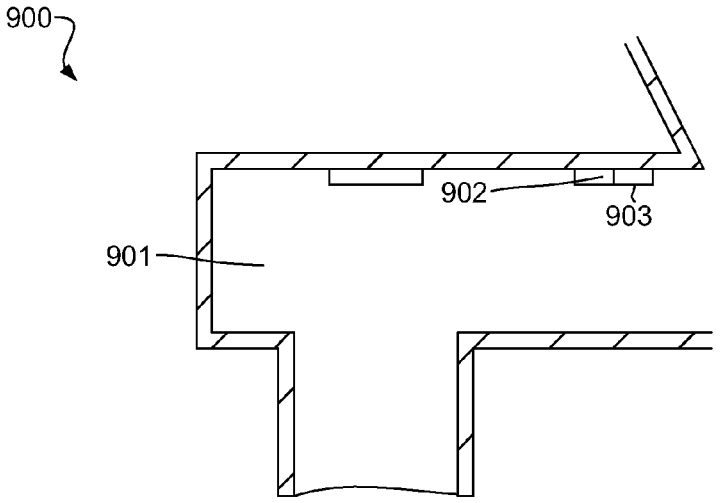
FIG. 9 is a diagram of an illustrative ink chamber, according to principles described herein.

FIG. 9 is a diagram of an illustrative ink chamber (900), according to principles described herein. In this example, the sensor (901) has a first region (902) and a second region (903) that collectively increase the surface area of the sensor (901) over the example of FIG. 2. Such a larger surface area may allow the sensor (901) to take measurements of the ink chamber (900) with a greater resolution.

In some examples, both the first and the second region (902, 903) are on a common metal plate. In other examples, the first and second regions (902, 903) are separate metal plates that are electrically connected to one another in parallel.

The first and the second region (902, 903) may be arranged to take individual impedance readings, which may be summed together to form a single output. In this manner, the processor may use multiple readings taken at substantially the same time to decipher the health condition of the ink chamber (900). As the drive bubble expands, the drive bubble may contact the first region (902) before contacting the second region (903). Further, as the drive bubble retracts, the drive bubble may recede from the second region (903) before receding from the first region (902). Thus, at specific times under certain conditions, the drive bubble may be in contact with the first region (902), but not the second region (903).

In examples where the first and second regions (902, 903) are connected in parallel, the first measurement includes taking a first set of readings at a first substantially same time. A first reading in the set may include an impedance value associated with the first region (902) and the second reading may be associated with the second region (903). In situations where both the first and the second regions (902, 903) are both in contact with the drive bubble or both are in contact with the liquid ink, both readings may be substantially the same. However, in situations where the first region (902) is in contact with the drive bubble and the second region (903) is in contact with liquid ink, the readings may be significantly different.

Also, in some examples, the second measurement includes taking a second set of readings from the first and the second regions (902, 903) at a second substantially same time. In some examples, the sensor (901) has three or more regions capable of taking separate impedance measurements, which may be summed together.

Figure 10:
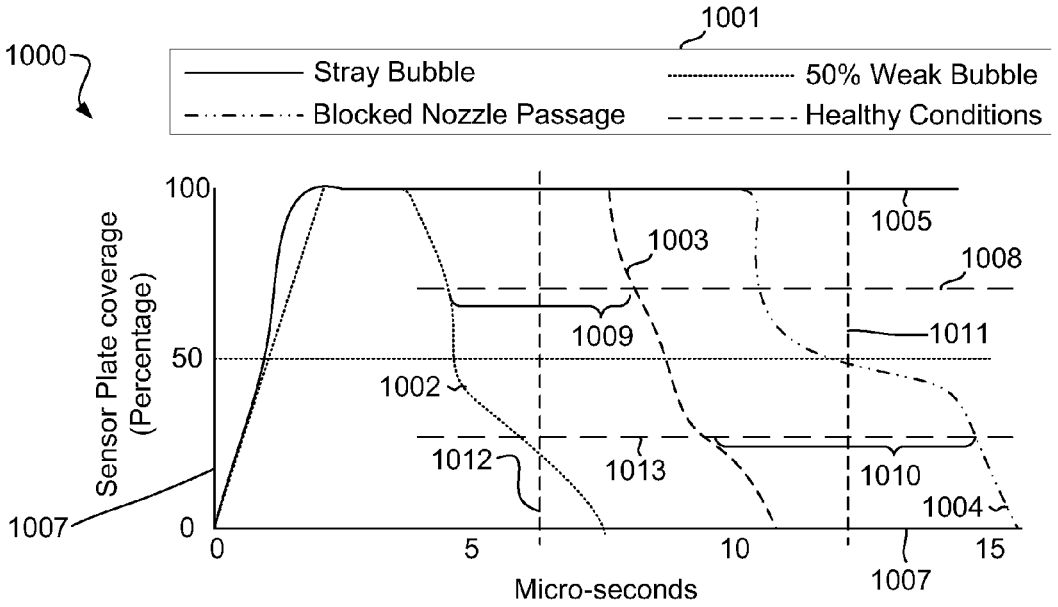
FIG. 10 is a diagram of an illustrative chart showing a summation of typical drive bubble life spans, according to principles described herein.

FIG. 10 is a diagram of an illustrative chart (1000) showing a summation of drive bubble life spans derived from the readings of each region taken at substantially the same time, according to principles described herein. In the example of FIG. 10, a legend (1001) details which lines (1002, 1003, 1004, 1005) correspond to which nozzle health conditions. The y-axis (1006) schematically represents the drive bubble coverage as a percentage of the sensor plate, while the x-axis (1007) schematically represents the time in microseconds since the drive bubble formation mechanism was activated. In this example, the sensor plate coverage measured by the y-axis (1007) includes both a first and a second region of the sensor.

In this example, line (1008) schematically represents a first threshold level, which is a level utilized for the first measurement (1012) to differentiate between a "1" and a "0" in binary code. For example, if the first measurement (1012) is above the line (1008), the measurement may be converted to a "1" in binary code. On the other hand, if the first measurement (1012) yields a value below line (1008), then the binary signal would be a "0." In this example, line (1013) schematically represents a second threshold level, which may be used by the second measurement (1011) when converting signals into a binary format.

In the example of FIG. 10, the bubble life spans in the chart (1000) may be experimentally derived from impedance measurements. In this example, the measurements are summed together, which results in the descending slopes of the lines (1002, 1003, 1004, 1005) flattening out.

In the example of FIG. 10, the flatten sections may be advantageous because along threshold line (1008), the distance (1009) between line (1002) and line (1003) is greater than that shown in the example of FIG. 7. Thus, the summation provides a greater time window of opportunity to take a measurement while still being able to confidently determine whether there is a weak bubble formation. In some examples, the system is able to make a measurement within two microseconds or less. However, increasing the first measurement's window of opportunity to over four microseconds allows the system to use less timing precision while still accurately determining the ink chamber's condition.

Also, the distance (1010) between line (1003) and line (1004) along threshold line (1013) may also be greater than that in the example of FIG. 7. As explained above, the increased distance represents a greater window of opportunity to take the second measurement.

Further, the flattening out of the descending slopes of the lines (1002, 1003, 1004, 1005) allows for the use of multiple thresholds levels, such as the first threshold level (1008) and the second threshold level (1013). The use of multiple levels allows for more targeted sampling of the nozzle to distinguish between nozzle health conditions. In comparison to FIG. 7, where a single threshold level was used when approximately fifty percent of the sensor plate was in contact with a bubble, a second measurement taken at about twelve microseconds would not have distinguished between healthy conditions and a blocked nozzle condition. However, by using a lower threshold level (1013) in the example of FIG. 10, the second measurement may confidently distinguish between the conditions.

Figures 11, 12:
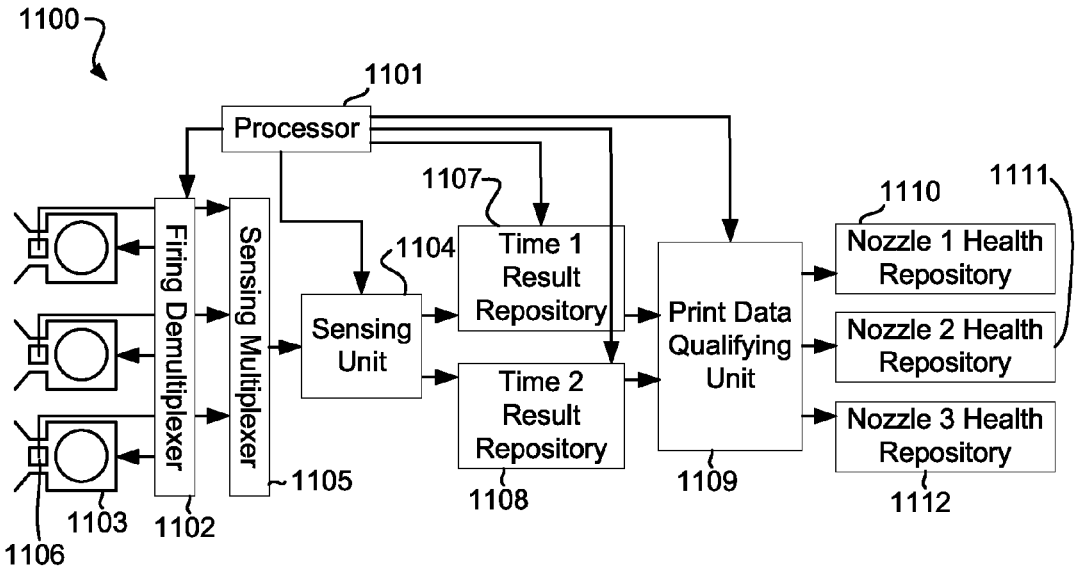
FIG. 11 is a diagram of illustrative circuitry to determine issues, according to principles described herein.
FIG. 12 is a diagram of an illustrative chart showing issue determinations, according to principles described herein.

FIG. 11 is a diagram of illustrative circuitry (1100) to take measurements, according to principles described herein. A processor (1101) may control the timing for both firing the nozzle and taking measurements within the ink chamber. In the example of FIG. 11, a processor (1101) is in communication with a firing demultiplexer (1102), which directs a firing command from the processor (1101) to the predetermined nozzle (1103). When the predetermined nozzle (1103) receives the firing command, the drive bubble formation mechanism, such as a heater, initiates the formation of a drive bubble in the ink chamber. The processor (1101) may also send a measurement command to the predetermined nozzle (1103) to take a measurement with the sensor (1106) in the ink chamber after the firing command is sent. In some examples, the measurement command is sent between five and thirty five seconds after the firing command is sent.

In some examples, an amplifier is included in the circuitry to amplify the measurement signal. Also, a digital-to-analog converter may convert the commands into an analog signal for taking the measurement, and an analog-to-digital converter may convert the measured signal back into a digital signal for processing.

The measurement taken in response to the measurement command may be sent to a sensing multiplexer (1105) that routes the measurement information to a sensing unit (1104) to interpret the information. The sensing unit (1104) may be in communication with time repositories (1107, 1108) that contain information about what impedance value each nozzle would have at specific times after a firing event. For example, the first time result repository (1107) may include impedance values that correspond to measurements taken at nine microseconds after a firing event. In such an example, the first time result repository (1107) includes a look-up table that indicates that if the drive bubble has fifty percent strength, then the impedance value would have a zero percent coverage at nine microseconds. Also, the first time result repository (1107) may also indicate that the sensor plate coverage would be about thirty five percent to sixty percent at nine microseconds if the predetermined nozzle (1103) has a healthy condition. Further, the first time result repository (1107) may indicate a hundred percent coverage if either a blocked nozzle or stray bubble condition exists at nine microseconds.

The second time result repository (1108) may have a similar look-up table that indicates the impedance values that correspond with the sensor plate coverage at the time that the second measurement is taken.

The information from the first and second time repositories (1107, 1108) may be further sent to a print data qualifying unit (1109) that is in communication with the processor (1101) that instructs the nozzles to fire. The print data qualifying unit (1109) may confirm that the nozzle was fired. In some examples, the processor (1101) may send a measuring command without a preceding firing command to test the condition of the nozzle. In such situations, the print data qualifying unit (1109) would indicate the absence of a firing command.

The print data qualifying unit (1109) may be in communication with a nozzle health repositories (1110, 1111, 1112), which may make a final determination on the specific condition of the predetermined nozzle (1103) taking into account the information from the time repositories (1107, 1008) and the print data qualifying unit (1109).

FIG. 12 is a diagram of an illustrative chart (1200) showing issue determinations, according to principles described herein. In this example, the chart (1200) includes a first column (1201) and a second column (1202) that includes measurement inputs (1205) at different times of when a drive bubble is expected and when a drive bubble is not expected. Further, the chart (1200) includes a third column (1203) and a fourth column (1204) that contain interpretations (1206) of the inputs (1205) depending on whether the nozzle has been commanded to fire or not.

In the example of FIG. 12, the chart (1200) indicates that when both the inputs (1205) in the first and second columns (1201, 1202) are high impedance values and there was no command to fire the nozzle then the nozzle may have a deprimed condition, which is a condition where the ink chamber fails to fill completely with liquid ink or the chamber fails to fill at all. A deprimed condition may occur if the ink chamber inlet is blocked. In the example of FIG. 12, the chart (1200) indicates that if both the first and the second inputs are high impedance values and the nozzle was commanded to fire, then the interpretation in the fourth column (1204) is that nozzle has a blocked nozzle or a deprimed condition.

Further, the chart (1200) also indicates that if both the inputs of both the first and the second column (1201, 1202) are low impedance values in the absence of an command to fire the nozzle, then the interpretation is that the nozzle has a healthy condition. Further, if the inputs are low impedance values when the nozzle was commanded to fire, then the interpretation is that the drive bubble is weak or the nozzle failed to fire.

Both the third and the fourth columns (1203, 1204) include interpretations (1206) that indicate particular sets of inputs are unexpected when the in the presence or absence of firing commands. For example, in the absence of a firing command, it would be unexpected for the input to be a high impedance value when a drive bubble was expected and the other input to be a low impedance value when ink was expected. Such a situation may not account for a healthy or predicted type of unhealthy nozzle condition. As a consequence, if such inputs are recorded, then the interpretation is that there is an issue with the sensing circuitry. Thus, the reliability of the sensing circuitry may be validated by taking first and second measurements when there is an absence of a firing command.

Figure 13:
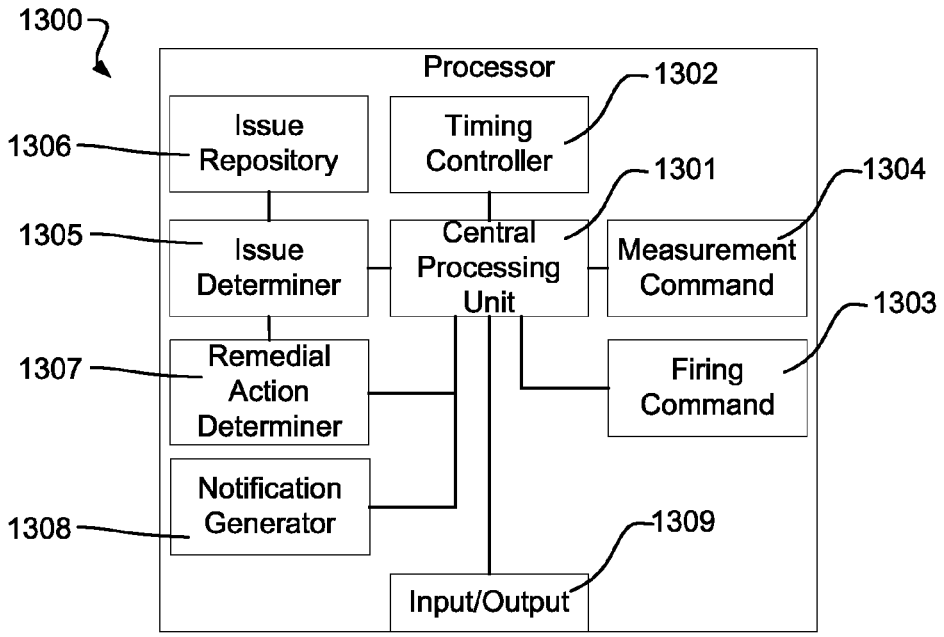
FIG. 13 is a diagram of an illustrative processor, according to principles described herein.

FIG. 13 is a diagram of an illustrative processor (1300), according to principles described herein. In this example, the processor (1300) has a central processing unit (CPU) (1301) that is controlled by a timing controller (1302). The CPU (1301) is in communication with an input/output (1309) to send commands and receive data. The CPU (1301) may communicate with a firing command (1303) to instruct a nozzle to fire by activating a drive bubble formation mechanism. After sending the firing command, the CPU (1301) may communicate with a measurement command (1304) to send an instruction to a sensor located within an ink chamber of the appropriate nozzle.

The measurement command may include instructions to take a first and a second measurement at specific times. In some examples, the time spacing between measurements may vary. Also, the measurement command may include multiple readings gathered from either multiple sensors or multiple regions of a common sensor during each measurement. In some examples, the measurement command instructs that more than two measurements are taken.

Upon receipt of the measurements taken in response to the measurement command, the CPU (1301) may send the received measurement to an issue determiner (1305). The issue determiner (1305) may reference an issue repository (1306) that may have a table of measurement values for specific time durations after a firing command is sent. Each of the measurement values for specific times may be associated with a specific type of issue. The issue determiner (1305) may determine that an issue exists or that an issue does not exist. In the situation that the issue determiner (1305) does determine that an issue exists, the determiner may communicate the issue to the CPU (1301). In some examples, the issue determiner (1305) communicates to the CPU (1301) the category of issue or specific type of issue determined.

The CPU (1301) may send the information about the determined issue to a remedial action determiner (1307) that may determine an action to take in response to the issue determined. The remedial action determiner (1307) may determine to take no action if the issue is minor, if the issue has a minimal affect on the printing job, or if the issue if not yet affecting the print job. The remedial action determiner (1307) may wait to make a decision and instruct the CPU (1301) to request the remedial action determiner (1307) to consider the situation later or request that the nozzle be measured again after sending another firing command.

The remedial action determiner (1307) may also determine to send a notification. When such an action is determined, the remedial action determiner (1307) may send the determined action to the CPU (1301). Upon receipt of a message to send a notification from the remedial action determiner (1307), the CPU (1301) may communicate with a notification generator (1308). The notification may be sent in conjunction with another remedial action determined by the remedial action determiner (1307).

In some examples, the remedial action determiner (1307) also determines whether the unhealthy nozzle is suitable to complete the printing job and may instruct the CPU (1301) to discontinue sending firing commands to the nozzle. The remedial action determiner (1307) may instruct the CPU (1301) to compensate for the unhealthy nozzle with at least one other nozzle that has a healthy condition.

In some examples, the CPU (1301) sends a measurement command after every firing command. In some examples, the CPU (1301) sends the firing command after a predetermined number of firing commands. In some examples, the CPU (1301) sends a measurement command after a firing command to each nozzle on a print head within a certain time period or after a predetermined number of firing commands per nozzle. In some examples, the measurement command is sent randomly.

In some examples, the measurement command is sent at a predetermined time after the firing command is sent. In some examples, the CPU (1301) sends the measurement command at different times following the firing command. In some examples, the CPU (1301) randomly selects a time to send a measurement command to a nozzle after the firing command.

Figure 14:
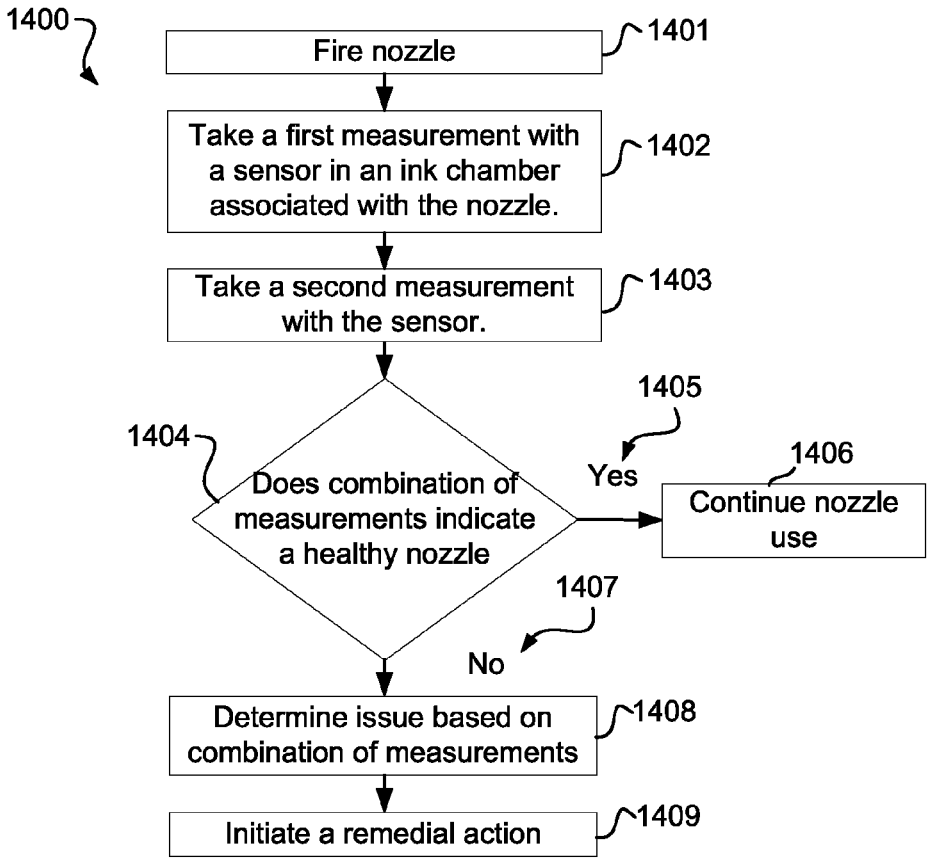
FIG. 14 is a diagram of an illustrative flowchart depicting a method for determining an issue, according to principles described herein.

FIG. 14 is a diagram of an illustrative flowchart (1400) for determining an issue in an inkjet nozzle, according to principles described herein. In this example, the method includes firing (1401) a nozzle followed by taking (1402) a first measurement with a sensor in an ink chamber associated with the nozzle and taking (1403) a second measurement with the sensor. The method (1400) may also include determining (1404) whether the measurement indicates that there is an issue with the nozzle. If the measurement indicates that there is no issue (1405), the nozzle may be continued to be used (1406).

If the measurement determines (1407) that an issue exists, the issue may be determined (1408) based on the combination of the first and second measurements. Once the issue is determined (1408), the method may include initiating (1409) a remedial action appropriate for the determined issue.

While the principles herein have been described with a specific number of measurements, any number of measurements may be taken to determine the health condition of a nozzle. Also, while the sensor plates herein have been described with a specific number of regions, any number of regions may be used.

While the principles herein have been described with specific ink chamber geometries, drive bubble formation mechanism placements, and sensor placements, any placement of components within the ink chamber and any geometry of the ink chamber are included within the scope of the principles described herein.

The preceding description has been presented only to illustrate and describe examples of the principles described. This description is not intended to be exhaustive or to limit these principles to any precise form disclosed. Many modifications and variations are possible in light of the above teaching.

What is claimed is:

1. A method for determining an issue in an inkjet nozzle with impedance measurements, comprising:

taking a first impedance measurement to detect a presence of a drive bubble with an impedance sensor coupled to an interior surface of an ink chamber; and taking a second impedance measurement to detect said drive bubble with said impedance sensor after said first impedance measurement.

2. The method of claim 1, wherein taking a second impedance measurement to detect a drive bubble with said impedance sensor after said first impedance measurement includes taking said second impedance measurement two to seven microseconds after said first impedance measurement.

3. The method of claim 1, further comprising determining said issue exists based on a combination of said first and second said impedance measurements.

4. The method of claim 3, further comprising determining a type of said issue based on said first impedance measurement, second impedance measurement, or combinations thereof.

5. The method of claim 3, further comprising initiating a remedial action in response to said issue with a processor in communication with said impedance sensor.

6. The method of claim 1, wherein taking a first impedance measurement to detect a drive bubble with an impedance sensor includes taking said first impedance measurement after a drive bubble formation mechanism is activated.

7. The method of claim 1, further comprising comparing said first and second measurements to firing commands to said ink chamber.

8. The method of claim 1, wherein taking a first impedance measurement to detect a drive bubble with an impedance sensor includes taking multiple impedance readings at a first substantially same time and taking a second impedance measurement to detect said drive bubble with said impedance sensor includes taking said multiple impedance readings at a second substantially same time.

9. The method of claim 1, further comprising:

determining an existence of said drive bubble when said first impedance measurement is above a first threshold impedance value; and determining said existence of said drive bubble when said second impedance measurement is above a second impedance value that is different than said first impedance value.

10. The method of claim 1, wherein taking a second impedance measurement to detect a drive bubble with said impedance sensor after said first impedance measurement includes taking the first and second measurements during a printing job, during a servicing event, or combinations thereof.

11. An ink jet print head, comprising:

an ink chamber comprising a drive bubble formation mechanism and an impedance sensor positioned on an interior surface of the ink chamber, the impedance sensor to detect a presence of a drive bubble as the drive bubble is created and contacts the impedance sensor;

said impedance sensor being in communication with a processor programmed to:

take a first impedance measurement within said ink chamber after initiating a drive bubble formation mechanism.

12. The print head of claim 11, wherein said processor is further programmed to send a firing command to a drive bubble formation mechanism in said ink chamber before taking said first measurement.

13. The inkjet print head of claim 11, wherein the processor is further programmed:

to take a second impedance measurement within said ink chamber after taking said first measurement; and to determine an issue in the ink chamber based on the first and second impedance measurements.

14. The inkjet print head of claim 13, wherein the processor is further programmed to take a remedial action in response to determining the issue.

15. The ink jet print head of claim 14, the processor further comprising a table specifying a remedial action to take based on both the first and second impedance measurements.

16. The ink jet print head of claim 11, further comprising a sensing multiplexer to provide output from impedance sensors in a plurality of ink chambers.

17. The ink jet print head of claim 11, further comprising:

first and second time results repositories for storing, respectively, impedance measurements taken a first time after initiation of a bubble formation mechanism, and impedance measurements taken a second, subsequent time after initiation of a bubble formation mechanism; and a nozzle health repository for storing information about a health of a nozzle corresponding to said ink chamber.

18. A printer, comprising:

a nozzle in fluid communication with an ink chamber, said ink chamber comprising a impedance sensor to detect a presence of a drive bubble within the ink chamber; and said impedance sensor being in communication with a processor, said processor programmed to:

send a first measurement command to said impedance sensor;

send a second measurement command to said impedance sensor after said first measurement command; and determine an issue within said ink chamber based on measurements taken in response to said first and second measurement commands.

19. The printer of claim 18, wherein said processor is further programmed to send a firing command to a drive bubble formation mechanism in said ink chamber before sending said first measurement command.

20. The printer of claim 18, wherein said processor is further programmed to distinguish between issues from a group consisting of weak bubble formations, blocked chamber outlets, and stray bubbles.

* * * * *